United States Patent [19]

Fono et al.

[11] 4,132,522

[45] Jan. 2, 1979

[54] CONTROL OF DYE MIGRATION IN THERMOSOL DYEING PROCESSES

[75] Inventors: Andrew Fono, Montclair, N.J.; Ray F. Patton, Burlington, N.C.

[73] Assignee: Royce Chemical Company, East Rutherford, N.J.

[21] Appl. No.: 776,854

[22] Filed: Mar. 11, 1977

[51] Int. Cl.[2] ..... D06P 3/87; D06P 1/56; C09B 67/00

[52] U.S. Cl. ..... 8/17; 8/18 R; 8/21 C; 8/25; 8/88; 8/87; 8/85 R; 8/34

[58] Field of Search ..... 8/17, 83, 85, 18 R, 8/25, 21 C, 88

[56] References Cited

U.S. PATENT DOCUMENTS

| | | | |
|---|---|---|---|
| 2,275,991 | 2/1942 | Powers | 8/18 A |
| 3,099,635 | 7/1963 | Wagner | 8/18 R |
| 3,326,628 | 6/1967 | Olaj et al. | 8/17 |
| 3,504,996 | 4/1970 | Geoffrey | 8/21 C |
| 3,788,808 | 1/1974 | Falkenhag et al. | 8/34 |
| 3,798,172 | 2/1974 | Etters | 8/34 |

FOREIGN PATENT DOCUMENTS

| | | | |
|---|---|---|---|
| 761338 | 6/1967 | Canada. | |
| 871193 | 6/1961 | United Kingdom. | |
| 1080237 | 9/1967 | United Kingdom | 8/85 |

OTHER PUBLICATIONS

Silverman, M. Amer. Dyestuff Reporter, Jan. 20, 1948, pp. 44–63.

Textile Chemist & Colorist, vol. 9, p. 192 (1975).

Dupont Technical Info. Bulletin No. D-270, Jun. 1973, pp. 12–13.

King, J. C., American Dyestuff Reporter, Feb. 17, 1964.

Shah, N. C., Silk & Rayon Industries of India, vol. 12, No. 5, pp. 265–286, (1969).

*Primary Examiner*—Donald E. Czaja
*Assistant Examiner*—Maria S. Tungol
*Attorney, Agent, or Firm*—Brumbaugh, Graves, Donohue & Raymond

[57] ABSTRACT

The specification describes the control of dye migration in continuous dyeing processes for cellulosic textiles. In the process, an antimigrating agent is added to the pigment pad. The antimigrating agent comprises an aqueous solution of a non-ionic polymer and a salt.

11 Claims, No Drawings

CONTROL OF DYE MIGRATION IN THERMOSOL DYEING PROCESSES

BACKGROUND OF THE INVENTION

Cellulosic textiles are commonly dyed with a mixture of vat and disperse dyes on a commercial scale using a continuous dyeing process known as the Thermosol process. The Thermosol process is described in the U.S. Pat. No. 3,957,427 to Chambers, which is incorporated herein by reference. This process may be characterized as having the following five steps (1) passing a cellulosic textile through a pigment pad containing a mixture of an unreduced vat dye and a disperse dye; (2) drying the dye-impregnated textile; (3) fixing the disperse dye on the dry textile by a heat treatment operation; (4) passing the textile with the unreduced vat dye and fixed disperse dye thereon through an alkaline reducing solution, called the chemical pad, at a temperature, below the vat dye reduction temperature, e.g. about 70° F. to 90° F., and (5) passing the textile with the dyes and reducing solution thereon into an air free developing chamber. In the developing chamber, the textile is subjected to steam.

It has been known that dye particles tend to migrate during the intermediate drying step of the aforementioned continuous dyeing process. The dye migration, which is uncontrolled and random in nature, leads to uneven dyeing which results in variations in the shade of the final dyed product. Such shade variation can detract from the appearance of the textile such as extent that the final dyed product is unmarketable.

In the past, various antimigrating agents have been added to the pigment pad in order to minimize dye migration. Among the agents disclosed in the prior art are natural gums, sodium alginate, and amide derivatives of polyvinyl methyl ether/maleic anhydride mentioned in the 3,957,427 patent and sodium chloride, Kelgin RL (Kelco Co.) and Superclear 100N (Diamond Shamrock) mentioned in *Textile Chemist and Colorist*, 7, 192 (1975); both of these are incorporated herein by reference.

None of the various antimigrating agents described in the prior art has found universal acceptance in the textile dyeing industry. Many agents merely increase the viscosity of the dye dispersion in the pigment pad without controlling migration significantly. Some agents tend to coagulate dye particles and consequently reduce color yield. Furthermore, the additional cost of certain antimigrating agents had discouraged their use on a commercial scale.

SUMMARY OF THE INVENTION

It has now been discovered that an aqueous solution containing critical amounts of a non-ionic polymer and a salt may be added as an antimigrating agent to the pigment pad in the Thermosol process. Thus, in accordance with one embodiment of the invention, a cellulosic textile is passed through a pigment pad to apply dye to the textile. The pigment pad contains (1) a mixture of an unreduced vat dye and a disperse dye and (2) an antimigrating agent comprising an aqueous solution of a non-ionic polymer and a salt. The textile with the dyes thereon is dried and is then subjected to a heat treatment operation to fix the disperse dye. Following disperse dye fixation, the textile is passed through a chemical pad solution maintained at a temperature above the vat dye reduction temperature. The chemical pad solution contains sodiums dithionite reducing agent, sodium hydroxide and an aldehyde addition product. The textile with the dyes and reducing agent thereon is subjected to steam in a developing chamber.

DETAILED DESCRIPTION OF THE INVENTION

The present invention is suitable for dyeing cellulosic textiles by the Thermosol process. The term "cellulosic textile" includes, without limitation, allcotton fabrics and yarns, or fabrics and yarns containing cotton blended with synthetic or other fibers, such as rayon, polyester, acetate and polyacrylonitrile fibers. The term covers any yarn, raw-stock or such fibers, or any such fabrics whether woven or knitted. These textile are also well known in the art (U.S. Pat. No. 3,798,172, which is incorporated herein by reference). The preferred textiles are cotton blends containing polyesters or acetates.

In the present invention, the pigment pad contains an aqueous dispersion of a mixture of an unreduced vat dye and a disperse dye. Such a mixture provides identical shades on blended cotton/synthetic textiles. As defined herein, a vat dye is one which is soluble in its reduced state in aqueous alkaline solution, e.g. quinone and anthraquinone dyes. These dyes are well known in the art [*Hackh's Chemical Dictionary*, 227 (4th ed. 1969), which is incorporated herein by reference.] A disperse dye is a water-insoluble, non-ionic dye which dissolves in certain textiles during the heat treatment operation. In the dye mixture, the amount of each dye may range from about 10% to 90%, preferably about 25% to 75%, by weight. The dye mixture is applied to the textile as it passes through the pigment pad. The temperature of the aqueous dispersion in the pigment pad is maintained in the range of about 80° F. to 160° F., and preferably about 120° F. to 140° F.

The pigment pad also contains an antimigrating agent comprising an aqueous solution of a non-ionic water-soluble polymer and a salt in critical amounts. The aqueous solution comprises about 0.25 to 0.55 ounces polymer per gallon and about 0.15 to 0.45 ounces salt per gallon.

The non-ionic water-soluble polymer, as defined herein, is a long-chain polymer having at least one nitrogen atom for every four carbon atoms, and having a molecular weight greater than 5,000. The polymer may also contain a carbonyl group, but is free of ionic substituents such as carboxylic acid, sulfonic acid, and basic amino groups. Suitable polymers which may be used as antimigrating agents in the pigment pad include, without limitation, polyamides, polyimides, melamine formaldehyde polymers, and urea formaldehyde polymers. In a preferred embodiment, the polymer is commercial grade melamine formaldehyde polymer.

The salt which is added may be defined by the formula MA, wherein M is sodium or potassium and A is chloride, sulfate, formate or acetate. The salts, therefore, are selected from the group consisting of sodium chloride, sodium sulfate, sodium formate, sodium acetate, potassium chloride, potassium sulfate, potassium formate and potassium acetate.

After emerging from the pigment pad, the textile is dried. In the present process, the textile is dried at about 250° F. to 350° F. for a sufficient time to dry the textile, preferably about one to five minutes.

The dried textile with the dye mixture thereon is then subjected to heat to fix the disperse dye on the textile. Using dry heat at a temperature of about 390° F. to 450°

F., the disperse dye is fixed on the textile in less than five minutes, preferably, between about thirty seconds and two minutes.

The textile containing the unreduced vat dye and the fixed disperse dye is then passed through a chemical pad solution maintained at a temperature above the reduction temperature of the vat dye. The dye reduction temperature is defined herein as that temperature at which the dye is reduced to its soluble leuco form. This temperature will vary according to the dye, with typical reduction temperatures being in the range of about 120° F. to 180° F. The reduction temperatures of many vat dyes are given in *The Application of Vat Dyes*, AATCC Monograph No. 2 (1953), which is incorporated herein by reference.

The textile may be immersed in the chemical pad solution for any suitable length of time. Frequently, about one to three seconds in the chemical pad solution will be sufficient.

The chemical pad solution contains sodium dithionite reducing agent, sodium hydroxide, and an aldehyde addition product. The amounts of component depends on the amounts of dye mixture used in the pigment and the nature of the textile among other things. The following amounts of sodium dithionite, sodium hydroxide and aldehyde addition product are generally used in the present invention: about 2 to 10 ounces per gallon sodium dithionite; about 1.5 to 6.0 ounces per gallon sodium hydroxide; and about 0.2 to 1.5 ounces per gallon aldehyde addition product.

It has been found to be advantageous to use the following relative amounts of vat dye, sodium dithionite, and aldehyde addition product in the present invention. In this regard, the molar ratio of aldehyde addition product to dye equivalents should be greater than about 0.7, preferably about 0.7 to 1.7. The molar ratio of sodium dithionite reducing agent to the sum of aldehyde product and vat dye equivalents should be greater than about 1.1, preferably about 1.1 to 2.25. The term "vat dye equivalents" is defined as the number of moles of a given vat dye multiplied by the number of quinone groups in the dye. A quinone group, as is well known in the art, contains two C=O groups. Typically, vat dyes contain one quinone group, but they may have from two to four groups. Although the amount of sodium hydroxide in the chemical pad solution is not critical, frequently it does not exceed about 3% by weight of the chemical pad solution.

The aldehyde addition product is added to the chemical pad solution to stabilize the reducing agent. Suitable aldehydes, without limitation, are formaldehyde, acetaldehyde and furfural; suitable adducts, without limitation, are bisulfite or sulfoxylate. The stabilizer, for example, may be formaldehyde-bisulfite, acetaldehyde-bisulfite, furfural-bisulfite, formaldehyde-sulfoxylate, acetaldehyde-sulfoxylate, furfural-sulfoxylate and mixtures thereof. The preferred compounds are formaldehyde-sulfoxylate and the aldehyde-bisulfite addition products described in the U.S. Pat. Nos. 3,645,665 and 3,798,172, which are incorporated herein by reference.

Other optional ingredients may be added to the chemical pad solution to facilitate dyeing. For example, a surface active agent or detergent, such as Nekal NF, may be added to reduce surface tension and to wet the cellulosic textile. A wetting agent, such as Duponol W.N., which is sodium alkyl sulfate, may be added. A chelating agent, such as ethylenediaminetetraacetic acid and salts thereof, may be added to complex iron and other heavy metal ions. Finally, a thickening agent, such as the polymeric material described in Etters, *Textile Chemist and Colorist*, 7, 209 (1975), which is incorporated herein by reference, may be added where it is advantageous to increase the viscosity of the chemical pad solution.

After leaving the chemical pad solution, the textile with the dyes and reducing agent enters the developing chamber which contains steam at a temperature of about 212° F. to 230° F. During this step, the vat dye is developed on the textile and excess water is evaporated. The textile remains in the chamber for about fifteen to sixty seconds, e.g., thirty seconds. Upon leaving the developing chamber, the textile is exposed to air to oxidize the reduced vat dye back to its insoluble form. Alternatively, chemical oxidation may be used. The textile is then rinsed, washed and dried.

With the present process, a uniformly dyed cellulosic textile is obtained using the Thermosol process. The textile has improved color properties such as hue and brilliance. In addition, the use of the antimigrating agent in connection with the conditions described herein has led to increases in the relative color yield for the dye of about 20% to 50%. Color yield of the textile is determined visually by experts in the field and represents the amount of dye required to obtain a desired shade for a given quantity of textile. In effect, therefore, the same color yield may be obtained with the present invention using about 20% to 50% less dye than with previous processes. Another advantage of the invention is that industrial waste will be reduced since there will be less non-biodegradable dye in the effluent. Finally, the dyed textiles exhibit improved wet fastness properties, such as wash fastness and wet crock fastness.

The following example is submitted to illustrate but not to limit the invention. Unless otherwise specified, all parts and percentages are based on weight.

EXAMPLE I

A blended textile of 65% polyester and 35% cotton was dyed with a vat-disperse dye mixture according to the Thermosol process described herein. The textile was passed through a pigment pad containing aqueous dispersion of the following mixture of vat and disperse dyes: (a) 9 ounces/gallon Vat Blue #16, 5 ounces/gallon Vat Black #16, and 1 ounce/gallon Vat Black #25 for a total of 15 ounces/gallon of vat dyes, and (b) 7.5 ounces/gallon Disperse Blue #79, 1.3 ounces/gallon Disperse Yellow #42, 1.0 ounce/gallon Disperse Orange #25, and 0.2 ounces/gallon Disperse Red #73, for a total of 10 ounces/gallon of disperse dyes. The above represents a mixture of 60% vat dye and 40% disperse dyes. The mixture provides identical shades on cotton and polyester textiles. The temperature of the aqueous dispersion in the pigment pad was maintained at 130° F. As an antimigrating agent, an aqueous solution of melamine formaldehyde polymer and sodium chloride was added to the pigment pad. The molecular weight of the polymer is greater than 5,000. The amounts of the components of the antimigrating agent in the final pigment pad mixture were 0.4 ounces/gallon melamine formaldehyde polymer and 0.3 ounces/gallon sodium chloride.

After passing through the pigment pad, the textile with the dye mixture thereon was dried at a temperature of 280° F. in three minutes. The dried textile was then subjected to heat at 425° F. for one minute to fix the disperse dyes.

After fixing, the textile was passed into a chemical pad solution containing 3 ounces/gallon sodium dithionite, 3 ounces/gallon sodium hydroxide, and 0.5 ounces/gallon sodium bisulfite-acetaldehyde addition product. Accordingly, the molar ratio of addition product to vat dye equivalents was approximately 0.9, and the molar ratio of sodium dithionite to the sum of addition product and vat dye equivalents was approximately 1.8. The temperature of the chemical pad solution was 140° F. which is above the reduction temperature of the vat dyes in the dye mixture. The textile remained in the chemical pad solution for three seconds.

After leaving the chemical pad, the textile was subjected to steam at 215° F. in a developing chamber for thirty seconds. The dyed textile was oxidized, washed and dried. The textile was evenly dyed, containing no shade variation or streaking.

The above textile dyed according to the invention was compared with one dyed without using an antimigrating agent. The textile dyed without the antimigrating agent, as a control, was unevenly dyed with streaks as a result of dye migration during the drying step.

Having set forth the general nature and specific embodiments of the present invention, the true scope is now particularly pointed out in the appended claims.

We claim:

1. A Thermosol process for dyeing a cellulosic textile with a vat-disperse dye mixture which comprises:

(a) passing a cellulosic textile through a pigment pad containing (1) an aqueous dispersion of a dye mixture of an unreduced vat dye and a disperse dye and (2) an antimigrating agent comprising an aqueous solution of about 0.25 to 0.55 ounces per gallon of a non-ionic water-soluble polymer selected from the group consisting of melamine formaldehyde and urea formaldehyde polymers and about 0.15 to 0.45 ounces per gallon of a salt selected from the group consisting of sodium chloride, sodium sulfate, sodium formate, potassium chloride, potassium sulfate, potassium formate, and potassium acetate, which is added to the aqueous dispersion of the dye mixture;

(b) drying the textile with the dye mixture thereon;

(c) heating the dried textile to fix the disperse dye in the dye mixture;

(d) passing the textile with the unreduced vat dye and fixed disperse dye thereon through a chemical pad solution maintained at a temperature above the reduction temperature of the vat dye of the dye mixture; said chemical pad solution comprising sodium dithionite, sodium hydroxide and an aldehyde bisulfite or an aldehyde sulfoxylate addition product; and (e) subjecting the textile obtained in step (d) to steam in a developing chamber.

2. The process according to claim 1 wherein the amount of each dye in the dye mixture of step (a) ranges from about 10% to 90% by weight.

3. The process according to claim 2 wherein the amount of each dye in the dye mixture of step (a) ranges from about 25% to 75% by weight.

4. The process according to claim 1 wherein the temperature of the aqueous dispersion of step (a) is in the range of about 80° F. to 160° F.

5. The process according to claim 1 wherein in step (b), the textile is dried at a temperature of about 250° F. and 350° F. for a time sufficient to dry the textile.

6. The process according to claim 1 wherein in step (c), the fixation temperature is about 390° F. to 450° F.

7. The process according to claim 1 wherein in step (d) the molar ratio of the aldehyde bisulfite or an aldehyde sulfoxylate addition product to vat dye equivalents is greater than about 0.7, the molar ratio of sodium dithionite to the sum of aldehyde addition product and vat dye equivalents is greater than about 1.1.

8. The process according to claim 7 wherein the molar ratio of aldehyde addition product to vat dye equivalents is about 0.7 to 1.7, and the molar ratio of sodium dithionite to the sum of aldehyde bisulfite or an aldehyde sulfoxylate addition product and vat dye equivalents is about 1.1 to 2.25.

9. The process according to claim 1 wherein the aldehyde addition product in the chemical pad solution is selected from the group consisting of formaldehyde-bisulfite, acetaldehyde-bisulfite, furfural-bisulfite, formaldehyde-sulfoxylate, acetaldehyde-sulfoxylate and furfural-sulfoxylate.

10. The process according to claim 1 wherein the amount of sodium hydroxide in step (d) does not exceed 3% by weight of the chemical pad solution.

11. The process according to claim 1 wherein the temperature of the steam in the developing chamber is maintained at about 212° F. to 230° F.

* * * * *